US006223643B1

(12) United States Patent
Müller

(10) Patent No.: US 6,223,643 B1
(45) Date of Patent: May 1, 2001

(54) OBTURATOR FOR A GUN

(75) Inventor: Ernst Johann Heinrich Müller, Pretoria (ZA)

(73) Assignee: Denel (Proprietary) Limited (ZA)

( * ) Notice: Subject to any disclaimer, the term of this patent is extended or adjusted under 35 U.S.C. 154(b) by 0 days.

(21) Appl. No.: 09/194,292

(22) PCT Filed: May 21, 1997

(86) PCT No.: PCT/EP97/02716

§ 371 Date: Jan. 11, 1999

§ 102(e) Date: Jan. 11, 1999

(87) PCT Pub. No.: WO97/44629

PCT Pub. Date: Nov. 27, 1997

(30) Foreign Application Priority Data

May 23, 1996 (ZA) ..... 96/4120

(51) Int. Cl.[7] ..... F41A 3/10
(52) U.S. Cl. ..... 89/26; 89/23
(58) Field of Search ..... 89/26, 23

(56) References Cited

U.S. PATENT DOCUMENTS 539,733 * 5/1895 Gerdom ..... 89/26
819,186 * 5/1906 Vollmer et al. ..... 89/26
1,376,130 * 4/1921 Asbury ..... 89/26
2,457,266 * 12/1948 Oliver ..... 89/26
2,482,865 9/1949 Oliver ..... 89/27.13

FOREIGN PATENT DOCUMENTS 1579 11/1889 (CH) .
3247744 * 6/1984 (DE) ..... 89/26
9610 * of 1890 (GB) ..... 89/26

* cited by examiner

*Primary Examiner*—Stephen M. Johnson
(74) *Attorney, Agent, or Firm*—Ostrolenk, Faber, Gerb & Soffen, LLP

(57) ABSTRACT

According to the invention there is a provided an obturation assembly for a gun of the type comprising a barrel of which a rear end defines a firing chamber having an obturation seat and the gun further having a breechblock, the obturation assembly comprising: an obturation set including an annular obturator pad for sealing against the obturation seat; an obturation spindle having a shaft and a head, the shaft extending coaxially through the obturator pad; a first shim for location between the obturation set and the breechblock, and a second shim for location between the obturation set and the head of the obturation spindle.

7 Claims, 6 Drawing Sheets

OBTURATOR FOR A GUN

INTRODUCTION AND BACKGROUND

A gun such as a cannon or the like is usually adapted to fire either cased or caseless ammunition. A gun having a firing chamber adapted to fire caseless ammunition is provided with an obturation assembly for sealing the rear end of the firing chamber when a propellant charge is combusted inside the firing chamber to launch a projectile. In the instance of guns adapted to fire cased ammunition, such sealing is effected by the case of the ammunition itself held in position by a breechblock.

A conventional obturation assembly, such as the one described in U.S. Pat. No. 2,482,865, comprises a spindle having a shaft and a mushroom shaped head; and an obturation set including a resilient obturator pad for mating with and sealing against an obturation seat, an inner ring and two retaining rings. The obturation seat is usually defined by the rim of the mouth at the rear end of the firing chamber. When the spindle is displaced axially relative to the barrel of the gun by the combustion of the propellant charge in the firing chamber, the obturator pad deforms radially outwardly into sealing engagement with the obturation seat with the retaining rings limiting deformation of the obturator pad and preventing extrusion of the obturator pad.

The obturation assembly is usually held in position by the breechblock of the gun and the shaft of the spindle usually extends through a hole in a carrier abutting the breechblock. A chamber for a cased primer for igniting the propellant charge, is provided in the shaft and a so called primer head space is defined between the rear end of the primer case and the breechblock.

When installing the obturation assembly, it is known to provide a shim, from a set having a range of different thicknesses, between the rear end of the obturation set and the breechblock in order to adjust the position of the obturator pad relative to the obturation seat and to optimise the mating of the obturation set with the obturation seat.

A disadvantage of the conventional method of adjusting the obturation set is that because the spindle abuts the obturation set directly, adjustment of the position of the obturation set, adjusts the position of the obturation spindle accordingly and the primer head space is thus varied. When the primer head space becomes too large, the primer case tends to slide out of the primer chamber thus allowing propellant gas to escape from the firing chamber past the primer.

The specification of patent number CH 1579 A (Schneider) dated Nov. 16, 1889 reveals an obturation assembly comprising an obturation pad located between two shims, two split rings and four separate resilient retaining rings. Some of the disadvantages of an obturation assembly of this type are that it is not suitable for use with a gun of the type having a breechblock and a cased primer for igniting the propellant charge.

OBJECT OF THE INVENTION

It is an object of the present invention to provide an obturation assembly for a gun utilising caseless ammunition and a method of optimising the mating of an obturator pad with an obturation seat and a shim kit with which the aforesaid disadvantage can be overcome or at least minimised.

SUMMARY OF THE INVENTION

According to the invention there is provided an obturation assembly for a gun of the type comprising a barrel of which a rear end defines a firing chamber having an obturation seat and the gun further having a breechblock, the obturation assembly comprising:

an obturation set including an annular obturator pad for sealing against the obturation seat;

an obturation spindle having a shaft and a head, the shaft extending coaxially through the obturator pad;

a first shim for location between the obturation set and the breechblock; and a second shim for location between the obturation set and the head of the obturation spindle;

the obturation assembly being characterised in that the first shim is one of a first set of shims having different thicknesses and the second shim is one of a second set of shims having different thicknesses; each of the shims of the first set being associated with one of the shims of the second set, thus enabling a user to select a suitable pair of associated shims for a particular position of the obturator pad relative to the breechblock.

Further according to the invention the thicknesses of associated shims complement each other so that the combined thicknesses of the different pairs of associated shims are the same.

According to another aspect of the invention there is provided a method for use with a gun utilising caseless ammunition of the type having a barrel of which a rear end defines a firing chamber having an obturation seat, the gun further having a breechblock and an obturation assembly including an obturation set for sealing against the obturation seat and an obturation spindle having a head and a shaft, the method including the step of optimising the mating of the obturation set with the obturation seat without altering a preselected position of the obturation spindle relative to the breechblock by:

providing a first set of shims having different thicknesses;

providing a second set of shims having different thicknesses, each of the shims of the first set being associated with one of the shims of the second set;

selecting a shim from the first set and locating the shim between the obturation set and the breechblock, the thickness of the first shim being selected to ensure an optimal mating of the obturation set with the obturation seat; and providing a second shim which is associated with the first shim between the obturation set and the head of the obturation spindle, the thickness of the second shim being selected to ensure that the preselected position of the obturation spindle relative to the breechblock is attained.

According to yet another aspect of the invention there is provided a shim kit for an obturation assembly of the type comprising an obturation set including an annular obturator pad for sealing against an obturation seat, and an obturation spindle having a shaft and a head, the shaft extending coaxially through obturator pad, the shim kit comprising:

a first set of shims having different thicknesses for location between the obturation set and a breechblock;

a second set of shims having different thicknesses for location between the obturation set and the head of the spindle;

each of the shims of the first set being associated with one of the shims of the second set.

Further according to the invention the thicknesses of associated shims complement each other so that the combined thicknesses of the different pairs of associated shims are the same.

Further according to the invention there is provided use of a shim kit as described above with a gun of the type comprising a barrel of which a rear end defines a firing chamber having an obturation seat and the gun further having a breechblock, the obturation assembly comprising:

an obturation set including an annular obturator pad for sealing against the obturation seat; and an obturation spindle having a shaft and a head, the shaft extending coaxially through the obturator pad.

BRIEF DESCRIPTION OF THE DRAWINGS

The invention will now be described further by way of example only with reference to the accompanying drawings wherein.

DESCRIPTION OF PREFERRED EMBODIMENTS OF THE INVENTION

Figure 1:
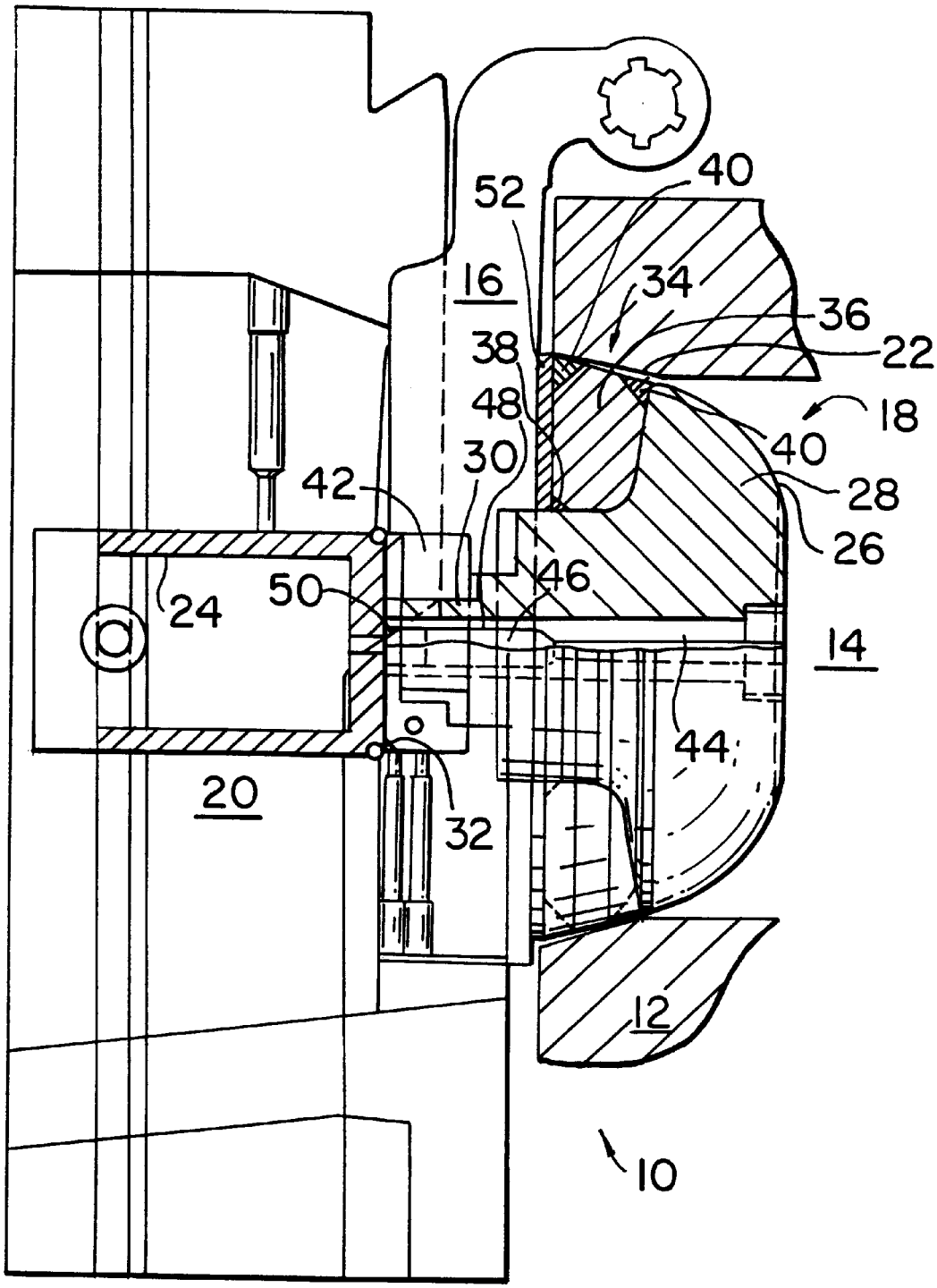
FIG. 1 is a diagrammatical longitudinal sectional view of a rear end of a barrel assembly of a gun such as a cannon or the like suitable for firing caseless ammunition, having a conventional obturation assembly.

Referring to FIG. 1, a rear end of a barrel assembly of a gun such as a cannon or the like suitable for firing caseless ammunition, is generally designated by reference numeral 10.

The barrel assembly 10 comprises a barrel 12 of which the rear end defines a firing chamber 14; a swinging breechblock 16; a conventional obturation assembly (generally designated by reference numeral 18); and a sliding breechblock 20.

The configuration of the conventional obturation assembly 18 will be described first and an obturation assembly according to a preferred embodiment of the invention will then be described in the light of the conventional obturation assembly 18.

The mouth of the firing chamber 14 provides an obturation seat 22 and the sliding breechblock 20 is provided with a trigger housing 24. The breechblocks 16 and 20 are moveable between an open or inoperative position (not shown) and a closed or operative position shown in FIG. 1, wherein the swinging breechblock 16 is held in position by the sliding breechblock 20.

Figure 1A:
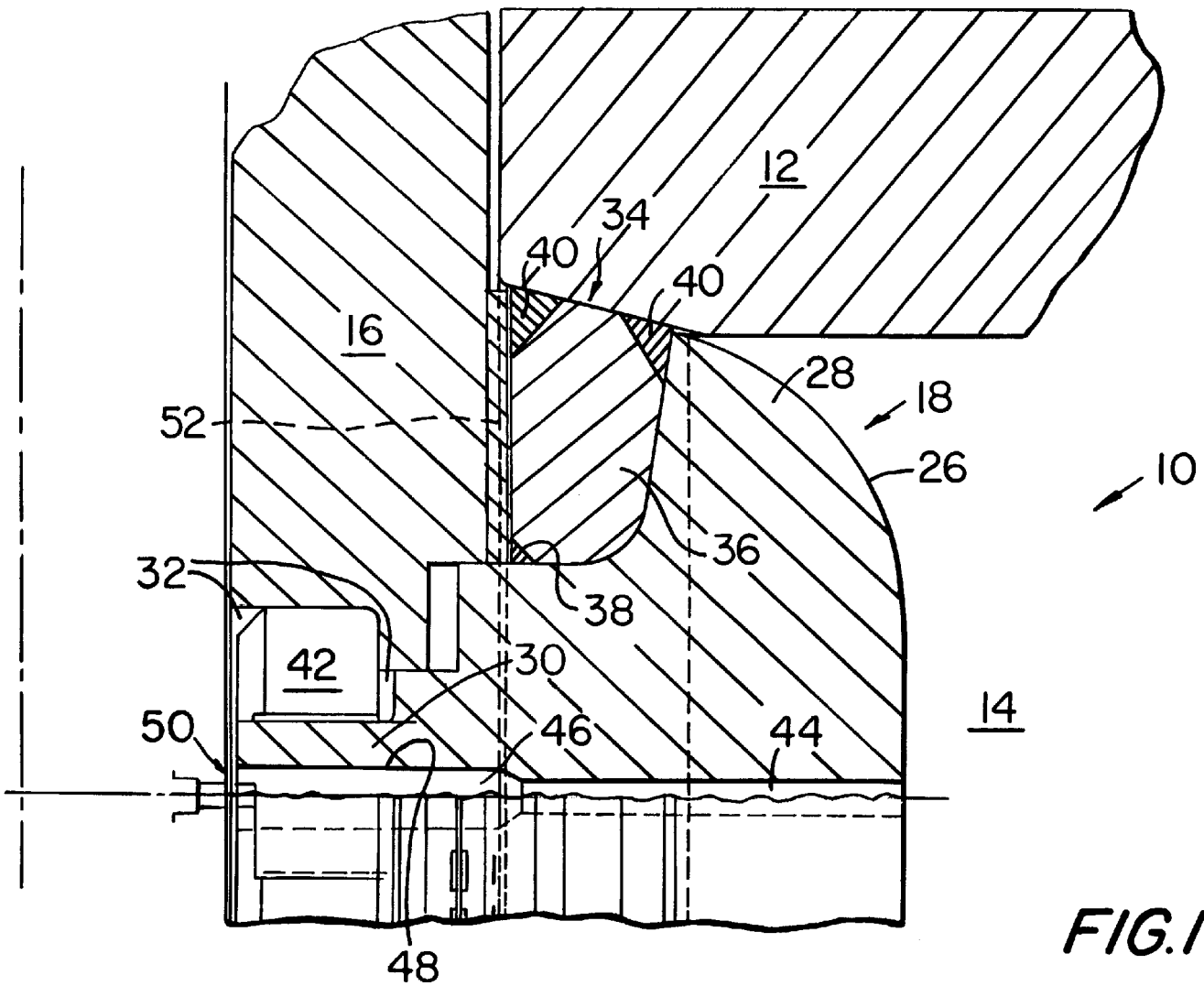
FIG. 1A is an enlargement of part of FIG. 1.

The obturation assembly 18 includes a metal spindle 26 having a mushroom shaped head 28 and a shaft 30 (shown more clearly in FIG. 1A) extending through a stepped hole 32 in the swinging breechblock 16. The obturation assembly 18 further includes an obturation set (generally designated by reference numeral 34) including an assembly of an annular obturator pad 36 of relatively hard resilient polymeric material or the like for mating with and sealing against the obturation seat 22; a metal inner ring 38; and front and rear metal retaining split rings 40.

The shaft 30 is connected to the swinging breechblock 16 by a nut 42. The shaft 30 is provided with an axially extending stepped bore 44 of which the rear end is provided with a chamber 46 for a primer case 48 for igniting a propellant charge when firing the gun. A primer head space 50 is defined between the rear end of the primer case 48 and the trigger housing 24. When the spindle 26 is displaced axially relative to the barrel 12 by the combustion of the propellant charge in the firing chamber 14, the obturator pad 36 deforms radially outwardly to seal against the obturation seat 22 and the rings 40 limit the radial and axial expansion of the obturator pad 36 to prevent extrusion of the obturator pad 36 under pressure.

When the mating of the obturation set 34 with the obturation seat 22 is to be optimised, the position of the obturation set 34 relative to the sliding breechblock 20 and thus relative to the obturation seat 22 is adjusted by providing a shim 52 from a first set of shims (FIG. 3A), having a range of different thicknesses, between the obturation set 34 and the sliding breechblock 20. The obturation set 34 is thus moved further away or closer to the sliding breechblock 16, depending whether a relatively thicker 52.1 or thinner shim 52.7 is selected from the first set of shims 52. In the conventional configuration of the obturation assembly 18, the spindle 26 abuts the obturation set 34 directly and a change in the position of thee obturation set 34 relative to the breechblock 16 will thus change the position of the spindle 26 accordingly.

Figure 2:
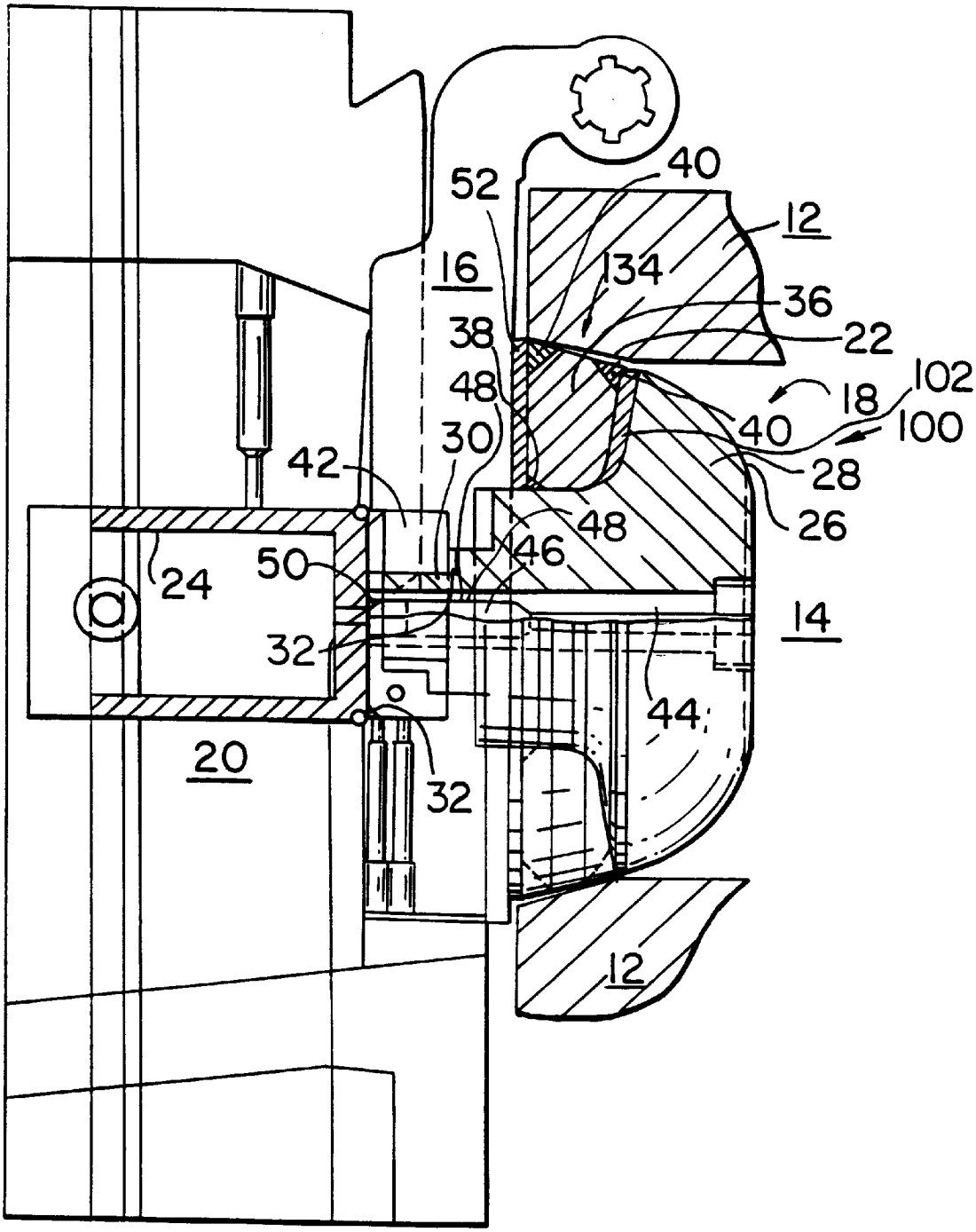
FIG. 2 is a similar view to that of FIG. 1 with the exception that it shows an obturation assembly according to a preferred embodiment of the invention.
Figure 2A:
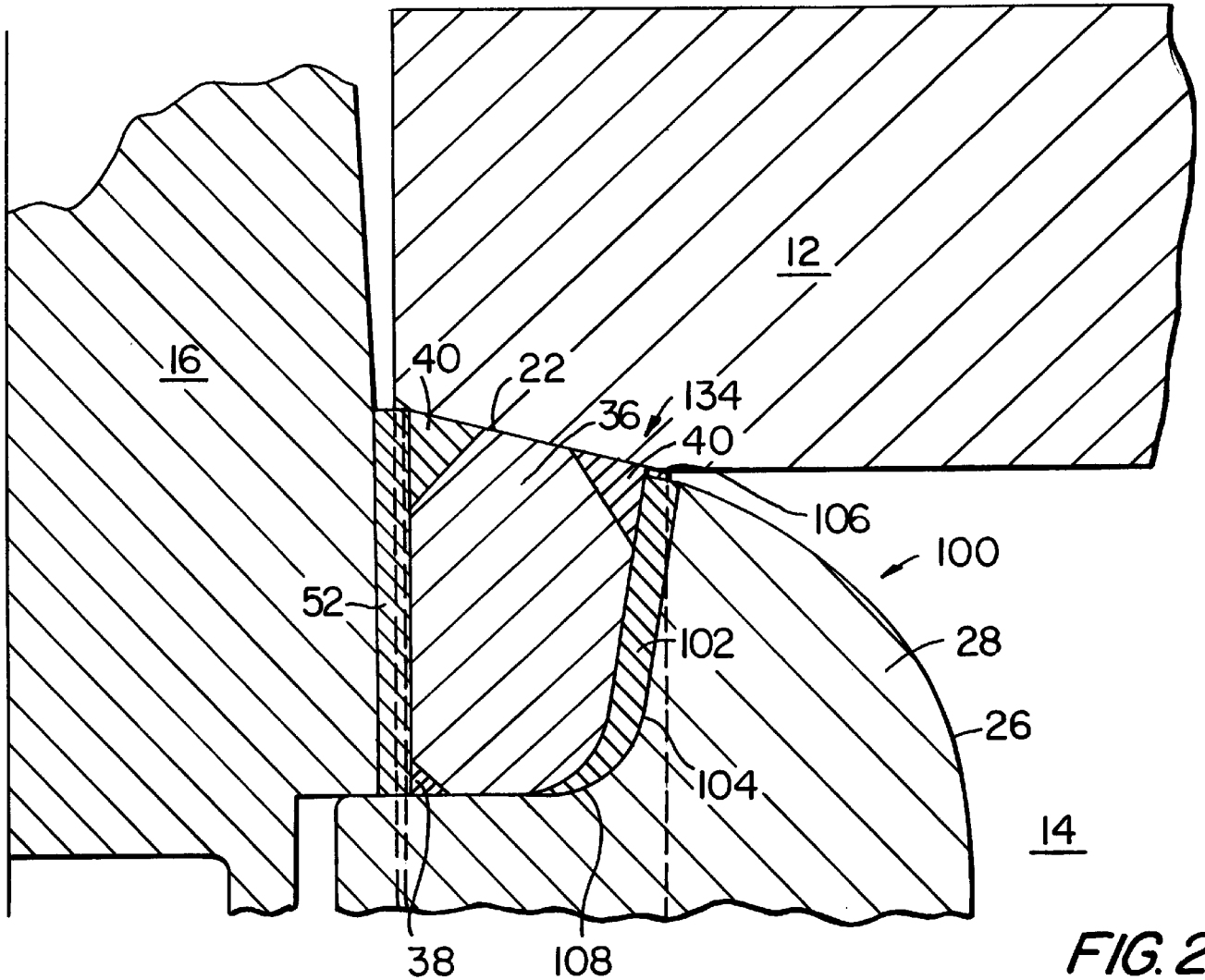
FIG. 2A is an enlargement of part of FIG. 2.
Figure 3A:
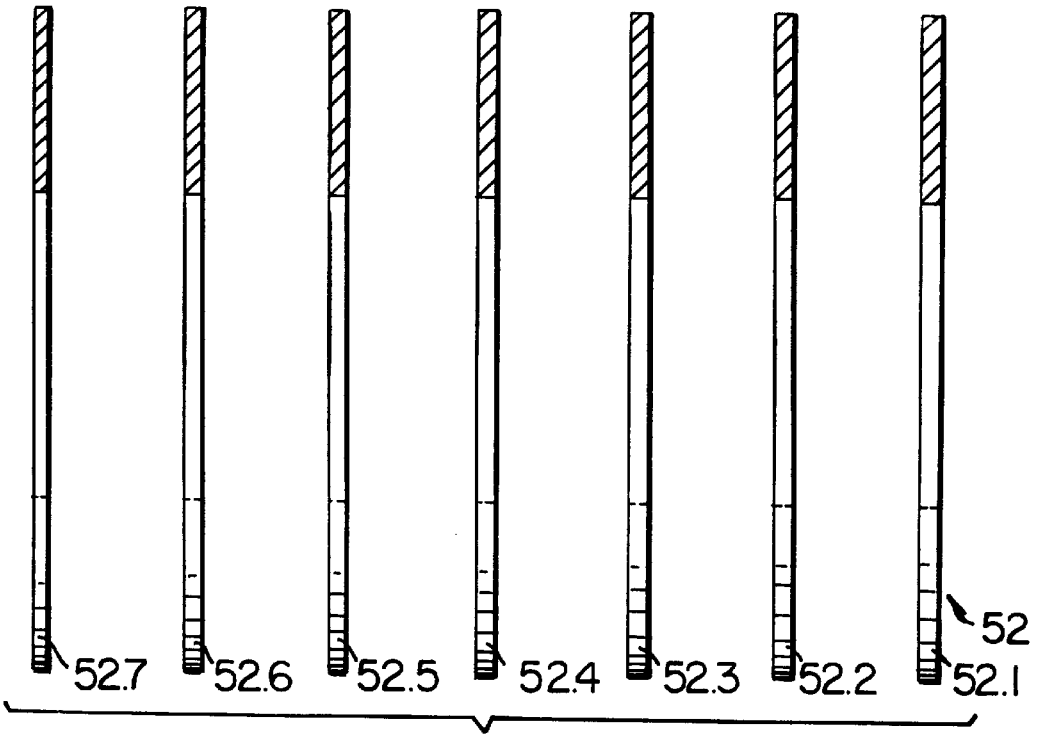
FIGS. 3A and B show partial cross-sectional side views of two sets of shims.
Figure 3B:
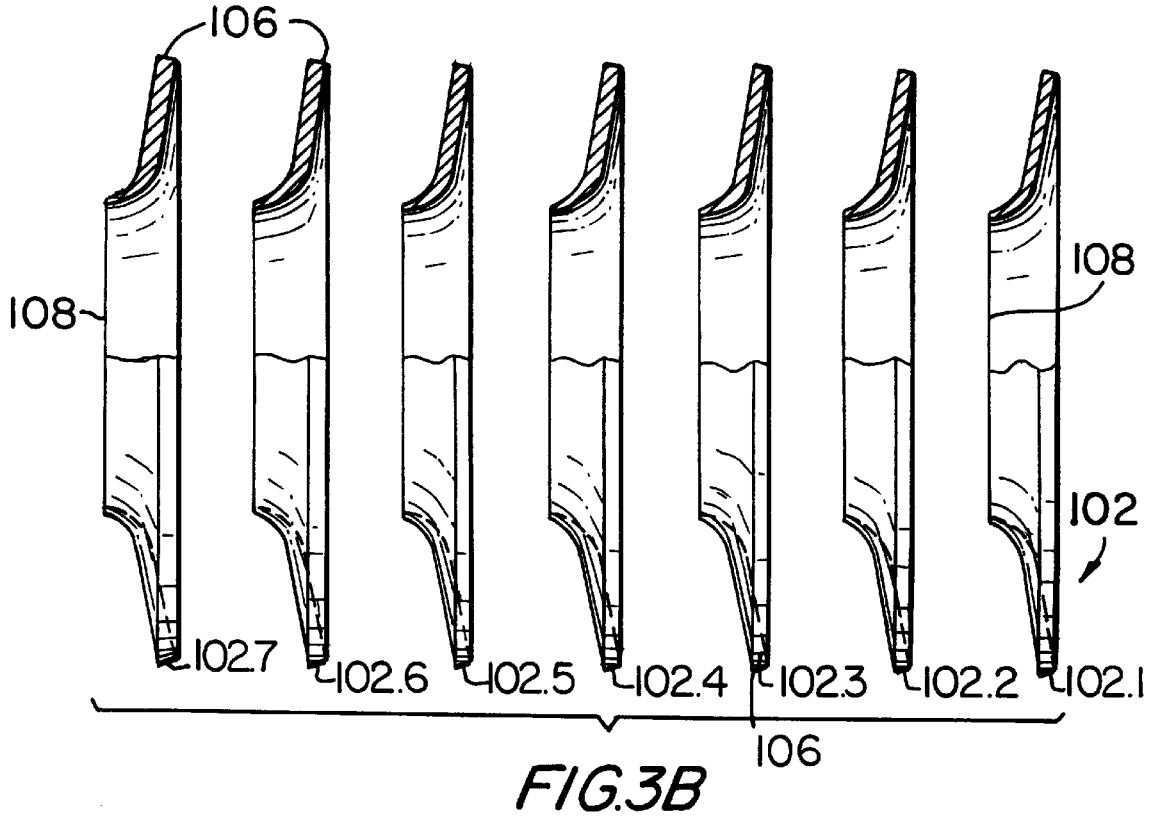

Referring to FIGS. 2 and 2A, an obturation assembly according to a preferred embodiment of the invention is generally designated by reference numeral 100. Referring to FIGS. 3A and 3B, the obturation assembly 100 includes a shim kit comprising a first set of seven shims 52 and a second set of seven shims 102. The shims of each set vary in thickness and each shim of the first set 52 is associated with one of the shims of the second set. One of the shims 102 of the second set is located between the leading end of the obturation set 134 and the rear end of the spindle head 28, so that the thickness of the second shim 102 which is used, is selected according to the thickness of the first shim 52. For example, when a shim 52.7 from the first set is replaced by a shim 52.6 from the same set but of increased thickness, to move the obturation set 134 further away from the sliding breechblock 16, the shim 102.7 from the second set is replaced by a shim 102.6 from the same set but of decreased thickness so that the position of the spindle 26 relative to the sliding breechblock 20 remains unchanged.

Figure 2C:
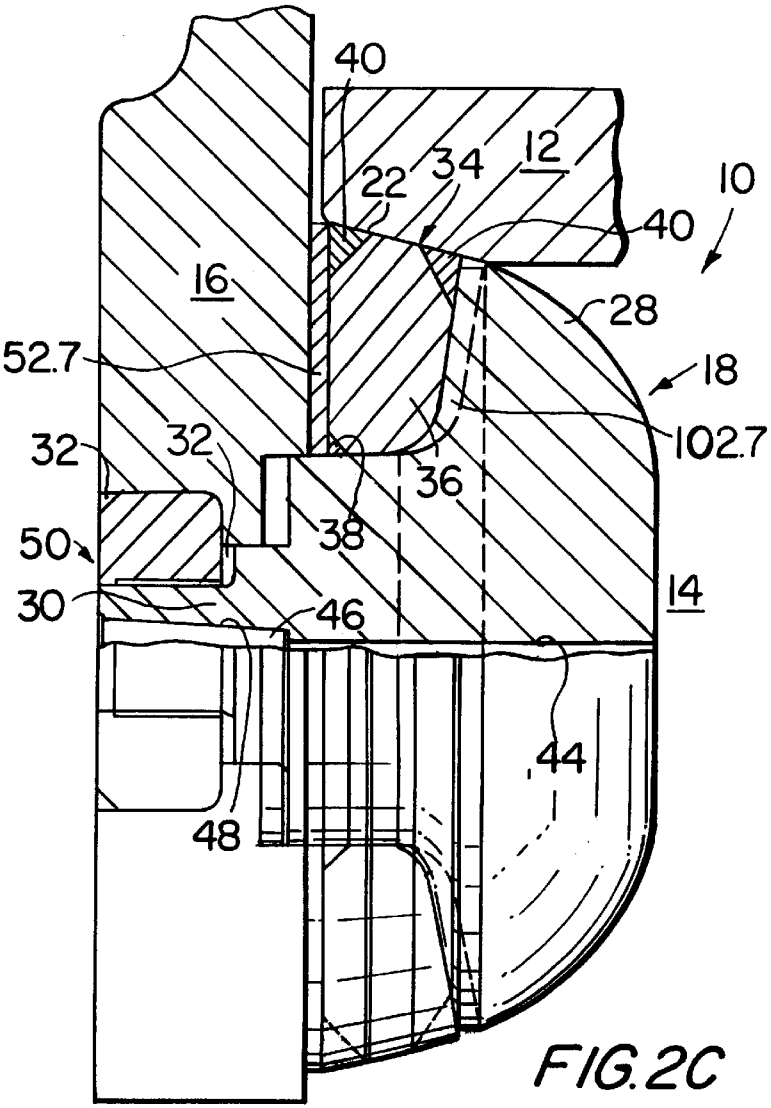
FIGS. 2B and C are similar views to that of FIG. 2 with the exception that in each view the obturation assembly is provided with a different pair of shims.
Figure 2B:
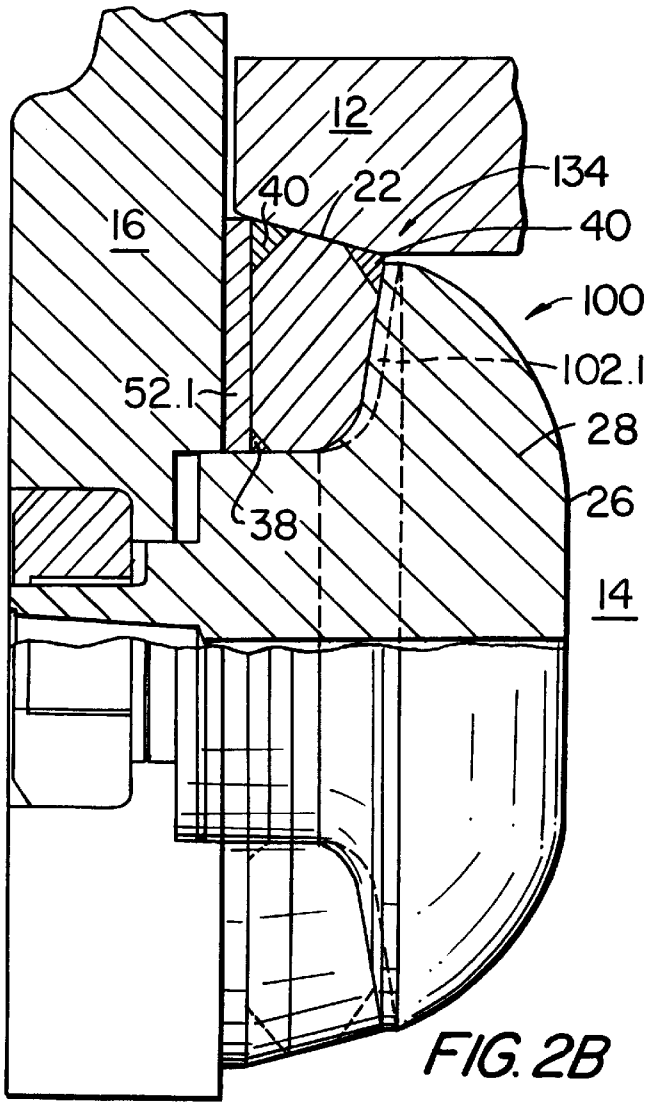

Referring to FIGS. 2B and C, further for example when a shim 52.1 (FIG. 2B) is selected which is approximately 1 mm thicker relative to the shim 52.7 (FIG. 2C) which is replaced, a shim 102.1 (FIG. 2B) is selected which is approximately 1 mm thinner than the shim 102.7 (FIG. 2C) which is replaced. A preselected position of the spindle 26 relative to the sliding breechblock 20, and thus the size of the head space 50, is thus maintained notwithstanding the adjustment of the position of the obturation set 134. The second shim 102 is selected from a second set of shims (shown in FIG. 3B) of different thicknesses and each of the shims 52 of the first range (shown in FIG. 3A) is associated with one of the shims 102 from the second set. The primer head space thus remains constant at a predetermined value.

Each shim 102 of the second set is contoured to match an inner contoured surface 104 (FIG. 2A) of the spindle head 28 and has an outer circumferential edge 106 (FIGS. 2A and 3B) which extends transversely to the general plane of the shim 102. Each shim 102 further has an inner pointed circumferential configuration 108 for merging with the contour of the inner surface 104 of the spindle head 28.

It will be appreciated that an obturation assembly according to the invention could be adapted for use with virtually any gun using caseless ammunition.

It will be appreciated further that a large number of variations in detail are possible with an obturation assembly, a kit and a method according to the invention for optimising the mating of an obturation assembly with an obturation seat without departing from the scope and/or spirit of the appended claims.

What is claimed is:

1. In a gun comprising a barrel having a rear end defining a firing chamber and the chamber having an obturation seat, and a breechblock;

an obturation assembly comprising:

an obturation set including an annular obturator pad for sealing against the obturation seat;

an obturation spindle having a shaft and a head, the shaft extending coaxially through the obturator pad;

a first shim for location between the obturation set and the breechblock; and a second shim for location between the obturation set and the head of the obturation spindle;

the first shim is one of a first set of shims having different respective thicknesses and the second shim is one of a second set of shims having different respective thicknesses; each of the shims of the first set being associated with a respective one of the shims of the second set, for enabling a user to select a suitable pair of associated first and second shims for a particular position of the obturator pad relative to the breechblock.

2. In the gun comprising the obturation assembly of claim 1, the thicknesses of the associated first and second shims of each pair thereof are selected to complement each other so that the combined thicknesses of the different respective pairs of associated first and second shims are the same.

3. A method for using caseless ammunition in a gun having a barrel with a rear end which defines a firing chamber and having an obturation seat, the gun further having a breechblock and having an obturation assembly including an obturation set for sealing against the obturation seat and an obturation spindle having a head and a shaft, the method comprising and providing a preselected position of the obturation spindle relative to the breechblock; optimizing the mating of the obturation set with the obturation seat without altering the preselected position of the obturation spindle relative to the breechblock by:

providing a first set of shims having different respective thicknesses;

providing a second set of shims having different respective thicknesses, associating each of the shims of the first set with a selected one of the shims of the second set;

selecting a first shim from the first set and locating the shim between the obturation set and the breechblock, the thickness of the first shim being selected to ensure an optimal mating of the obturation set with the obturation seat; and selecting a second shim from the second set wherein the second shim is associated with the first shim; positioning the selected second shim between the obturation set and the head of the obturation spindle, the second shim being selected such that the thickness of the second shim ensures that the preselected position of the obturation spindle relative to the breechblock is attained.

4. An obturation assembly comprising an obturation set including an annular obturator pad for sealing against an obturation seat, and an obturation spindle having a shaft and a head, the shaft extending coaxially through the obturator pad; and a shim kit comprising:

a first set of shims having different respective thicknesses for being located between the obturation set and a breechblock;

a second set of shims having different respective thicknesses for being located between the obturation set and the head of the spindle;

each of the shims of the first set being associated with a respective one of the shims of the second set to define a pair.

5. The assembly of claim 4, wherein each of the pairs of the associated first and second set shims has a selected respective thickness such that the thicknesses of associated shims of each pair thereof complement each other so that the combined thicknesses of each of the different pairs of associated first and second shims are the same.

6. In combination, the assembly of claim 5 and a gun comprising a barrel having a rear end which defines a firing chamber having an obturation seat and the gun further having a breechblock, the obturation pad sealing against the obturation seat.

7. In combination, the assembly of claim 4 and a gun comprising a barrel having a rear end which defines a firing chamber having an obturation seat and the gun further having a breechblock, the obturation pad sealing against the obturation seat.

* * * * *